United States Patent [19]

Reeves

[11] 4,090,945

[45] May 23, 1978

[54] METHOD OF OPERATING AN OIL SHALE KILN

[75] Inventor: Adam A. Reeves, Rifle, Colo.

[73] Assignee: Paraho Corporation, Grand Junction, Colo.

[21] Appl. No.: 781,072

[22] Filed: Mar. 25, 1977

[51] Int. Cl.[2] ..... C10G 1/02

[52] U.S. Cl. ..... 208/11 R; 201/1; 201/41; 202/151

[58] Field of Search ..... 208/11 R; 201/1, 8, 201/18, 34, 41

[56] References Cited

U.S. PATENT DOCUMENTS

| | | | |
|---|---|---|---|
| 3,001,916 | 9/1961 | Cheadle | 201/1 |
| 3,085,582 | 4/1963 | Slosman et al. | 201/1 |
| 4,025,416 | 5/1977 | Deering et al. | 208/11 R |

*Primary Examiner*—Herbert Levine
*Attorney, Agent, or Firm*—Richard D. Law

[57] ABSTRACT

Continuously determining the bulk density of raw and retorted oil shale, the specific gravity of the raw oil shale and the richness of the raw oil shale provides accurate means to control process variables of the retorting of oil shale, predicting oil production, determining mining strategy, and aids in controlling shale placement in the kiln for the retorting.

6 Claims, 4 Drawing Figures

METHOD OF OPERATING AN OIL SHALE KILN

The so called oil shales of the Western United States are marlstones containing large quantities of dolomite (a mixture of magnesium and calcium carbonates) and included organic material referred to as kerogen. This organic material is a high molecular weight organic material of an indefinite composition. It is generally insoluble in common solvents, but it does undergo a thermal decomposition, as in a distructive distillation or pyrolysis at temperatures above about 600° F. The pyrolysis of oil shale results in a "oil" and some gas. Such a thermal decomposition of oil shale has to date proven to be the only practical method of obtaining oil from oil shale. Effective pyrolysis of oil shales obtains at a temperature range of about 900°-1100° F. However, the decomposition rate of magnesium carbonate is quite rapid at about 1000°-1100° F, consuming substantial quantities of heat for the decomposition. Calcium carbonate on the other hand decomposes at about 1500°-1600° F, also, with a utilization of a substantial quanty of heat. A kiln in operation, at elevated temperatures and with sufficient heat, will first of all stabilize at about the magnesium carbonate decomposition temperature. The operation at these temperatures absorbs the amount of heat necessary to decompose the magnesium carbonate present so that additional heat is necessary to provide a decomposition of the kerogen. Of course, if additional heat is available at still higher temperatures, the operation when stabilizes at the decomposition temperature of the calcium carbonate. Very effective operation of an oil shale skin is carried out at about 1000° F maximum temperature to minimize the decomposition of the magnesium carbonate, and thereby utilize the available heat for the kerogen pyrolysis giving a high heat efficiency. From the above it is seen that in oil shale retorting, carbonate decomposition wastes heat, decreasing thermal efficiency. The produced carbon dioxide decreases the heating value of the product gases.

There are two general method of introducing heat into a kiln in a sufficient amount to provide the pyrolysis of the kerogen. A first method is called the direct heat method, in which the heat is supplied by combustion of combustible material in the kiln. An earlier patent (U.S. Pat. No. 3,736,247), shows a process in which the residual carbon, left in the shale after decomposition and evaporation of the kerogen products, is consumed to produce the heat necessary for the kerogen pyrolysis. According to the earlier patent referred to above, the combustion temperature may be kept low to mininize decomposition of the carbonates in the raw shale, which mininizes the quantity of combustion air required to release the heat necessary to keep the process in thermal balance. In this direct heated mode, a depth of raw shale is maintained above the combustion zone to cool the product gases (which contain the oil) and produce a mist. This oil mist, and other gases, are withdrawn from the vessel for separation and recovery of the oil and the product gas. In the indirect heated mode, such as an earlier patent (U.S. Pat. No. 3,841,992), a heater external of the kiln is used to provide a sufficient quantity of a generally non-combustible gas at a sufficient temperature to produce retorting of the shale in the kiln. This mode, also, utilizes a depth of raw shale above the retorting zone to cool the resultant products of the decomposition. In both cases, the retorted shale is cooled from its retorting temperature to a temperature for withdrawal from the kiln by injecting recycled gases into the bottom of the kiln. These gases pass upwardly through the retorted shale, through the retorting zone and exit the kiln along with the produces of the retorting.

In using a vertical kiln for retorting oil shale, the operation is normally conducted on a rather coarse size of oil shale rather than the finely ground shale. This not only saves the costs of crushing and grinding, but, also, reduces dust inherent in the bulk transfer of the finely divided material both in and out of the vertical kiln. With shale, as is conventional with other mining and beneficiation treatments of minerals, the actual mining and crushing of the oil shale to produce a particular size consist, for example, minus 3 inches plus ¼ inch, a portion of fines are produced and, of course, a substantial amount of these fines must be removed. The fines must be removed as it has been found that such fines may be harmful to vertical kiln operation. The major part of the problem in the use of fines, is the segregation of the fines from the larger lumps which occurs in the handling of the material. The segregation of the fines from the lump material occurs when the material is moved, as by dumping from a bin, travel on a belt conveyor, passing through feeding devices, and the like. When segregation of the fines occurs it is not uncommon to find substantial quantities of fines in one location in the kiln. On the whole, however, a good percentage of the fines may be tolerated in the operation of a vertical kiln so long as the fines are uniformly distributed in the size consist.

The establishment of operating parameters in the operation of an oil shale kiln is performed using actual measurements as (1) quantity of raw and retorted oil shale (measured continuously on a belt and measured in quantity per unit of time), (2) quantity of air and recycled gas (measured by rotometers, pressurized differential gauges, and the like) normally measured in standard quantity per unit of time, (3) various temperatures internally of ingoing and outgoing materials, (4) certain temperatures internally of the kiln, etc. Many desired measurements are available only after a considerable length of time, which is a long period after the fact. For example, the oil shale richness should be known as the shale enters the kiln, and preferably on a continuous use basis. However, this is presently determined by a Fischer Assay, which takes a substantial amount of time for sampling and analysis and it may be some 24 hours or more before the date is available to the kiln operator. This, of course, means that the operator is unaware of changes which occur in oil shale quality entering the kiln. Another measurement which is desirable is the size consist of the shale entering the vessel. This measurement is accomplished by a screening process of a grab sample, and the results are normally available only after several hours since the preparation of the sample consumes a substantial amount of time, and the actual screening consumes some time. Thus, it may be several hours after the increment from which the sample is taken enters the kiln. Additionally, the retorted shale has only been measured continuously as to weight, normally in quantity per unit of time, but the shale must be sampled and the ingredients then analyzed in a laboratory which provides results many hours after the shale has left the kiln.

Thus, it is seen that operation, which depends on laboratory results obtained many hours after obtaining samples, is neither precise nor positive. At best the retorting has been a matter of guess as to quality, rates, etc. of the ingredients entering and leaving the kiln. An experienced kiln operator can get the "feel" of the operation, but as shifts change, so does the feel of the different operators.

According to the present invention there is provided a continuous determination of the shale weight, a continuous determination of the bulk density of raw oil shale entering a kiln, a continuous measurement of the specific gravity of the feed entering the kiln, a continuous determination of the shale richness, a continuous weight and bulk density of the retorted shale, etc. all of which provides for precise operation of the kiln parameter changes are provided by an operator, taking immediate and proper corrective action as the particular determinations are made continuously during the operation.

It is, therefore, an object and advantage of the present invention to provide an accurate and continuous method of operating an oil shale kiln.

Another object of the invention is to continuously determine the bulk density of oil shale entering as feed to a kiln providing a determination for the immediate control of the various feed streams into an oil shale kiln.

Yet a further object of the invention is to provide a continuous bulk density determination of the solids feed of an oil shale kiln which provides a continuous monitor for the mining strategy of a mine producing oil shale for the kiln, the adjustments of the crushing and screening process, as well as providing for a continuous accurate adjusting of the variables to accommodate changing shale quality.

These and other objects and advantages of the invention may be readily ascertained by referring to the following description and appended illustrations in which.

In general, the invention provides a continuous and "real time" read out of such important kiln feed properties as raw and retorted shale bulk density, raw oil shale richness, as well as shale specific gravity. The continuous determination of the various data of the raw shale provides means for a accurate and continuous adjustment of the retorting to meet the process requirements of the varying properties of the raw shale. The continuous determination of the bulk density of the retorted shale is especially responsive to the degree of carbonate decomposition and, therefore, reflects a temperature history of the oil shale processing in the retort. The invention provides a combination of density and weight measurements to infer the specific gravity of granular solids. The combination of weight and volumetric measurements are used to determine continuously the bulk density of the granular solids. The invention, furthermore, provides detection of solids fractions in differential movement in large kilns. It provides for the use of an eccentric plug feeder rotating over a large retarder plate to distribute granular solids uniformly over a large area without segregation.

Figure 1:
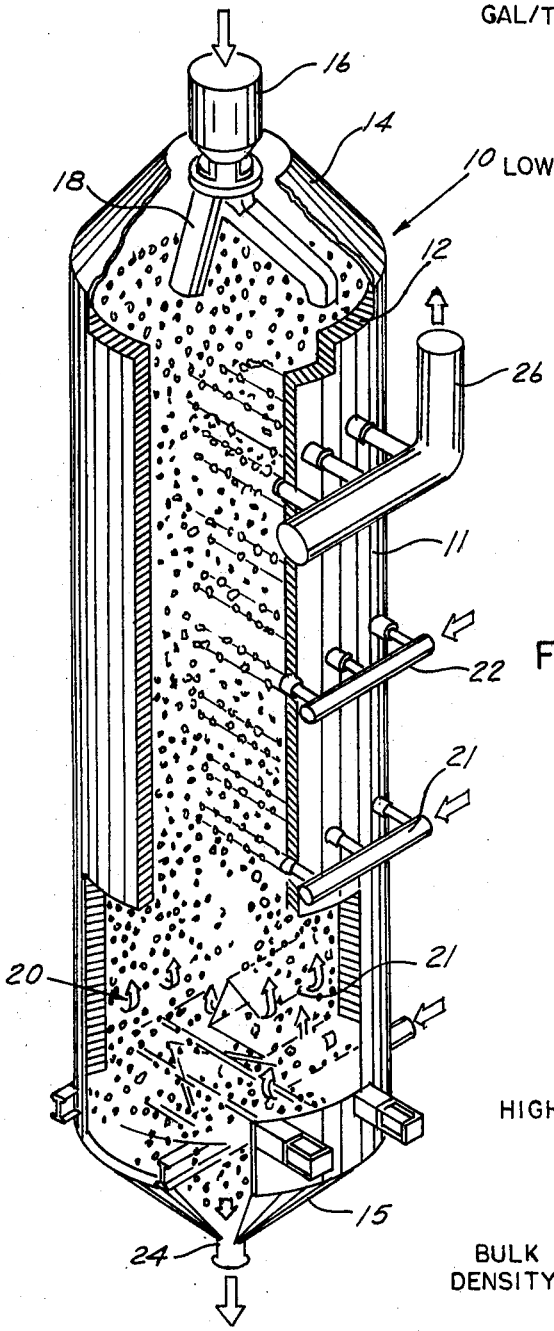
FIG. 1 is a perspective of one type of oil shale kiln showing the various parts and functions of the parts in an oil shale retorting process.

In the device shown in FIG. 1, a vertical kiln, shown in general by numeral 10, includes a skin 11 and a refractory material 12. The kiln provides a desired vertical height of and is generally open internally, except for means for distributing gas into the particulate matter in the kiln. The top of the kiln is closed by a head 14 and the bottom is closed by a conical head 15. A feed arrangement, normally a belt conveyor, feeds raw particulate shale to a surge bin 16 at the top of the vessel providing shale to a rotating spreader 18. Shale is removed from the vessel by means of a grate mechanism, shown in general by numeral 20, which, also, includes means for introducing gas into the bottom of the vessel. Such means are openings 21 along deflector plates at the level of the grate. An earlier patent (U.S. Pat. No. 3,777,940) shows one method. Gas may, also, be introduced into the vessel by means of lower distributors 21 and upper distributors 22 which are types like distributors extending across the extent of the vessel and provided with openings for introducing gas into the particulate matter in the vessel. Retorted shale is withdrawn from the bottom head 15 through an outlet 24 and a suitable gas seal not shown, which may be discharged onto the moving belt conveyor for removal.

Figure 2:
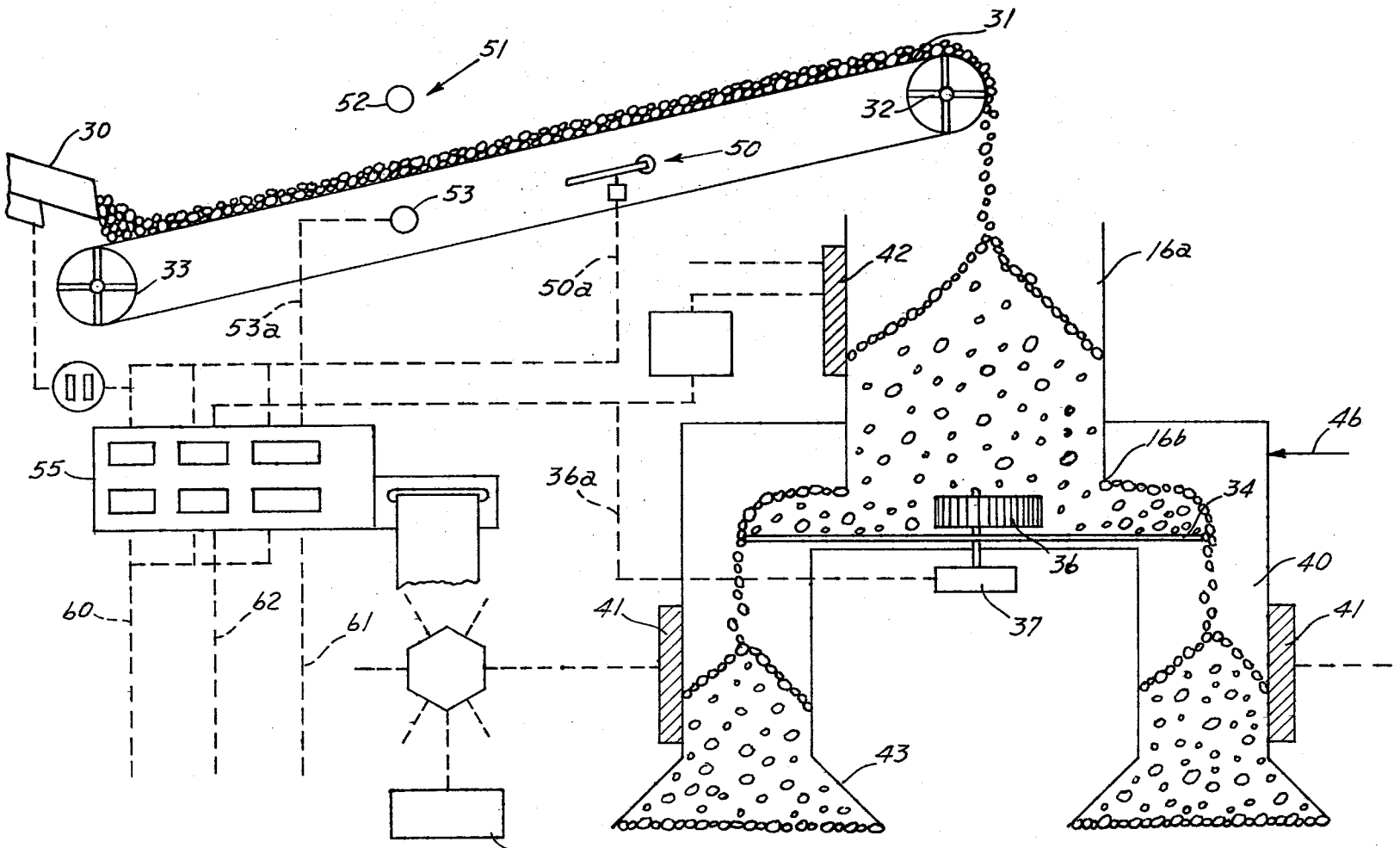
FIG. 2 is a generally schematic flow diagram and control circuitry for the measurement and adjustment of the feed systems of a vertical kiln.

The system, shown in FIG. 2, includes a feeder 30 which passes particulate oil shale from a bin, not shown, onto a moving belt conveyor 31 having an upper head pulley 32 and a lower tail pulley 33. Shale is transmitted by the belt and is deposited into a feed bin **16*a* analogous to the surge line 16 in FIG. 1. Particulate shale is retained in the feed bin by means of a retarder plate 34 mounted below the lower end of the wall 16*b* of the feed bin 16*a*. The distance between the ends 16*b* and the retarder plate 34 is determined by the size of the shale, and may be from 6 to 12 inches or more depending upon the size consist of the shale or the dimensions of the largest particulate which are feed into the feed bin. An eccentric plug feeder 36 is rotated by means of a drive 37. Rotation of the plug feeder 36 pushes shale off of the retarder plate completely around its periphery into a annular, level bin 40. A series of at least 6 level sensors 41 are mounted around the annular level bin to ascertain the level of the shale in the annular opening. Feed from the annular opening passes into a vertical kiln therebelow, the kiln not being shown but extends downwardly from the diverging bottom 43 of the bin into the kiln proper. A level sensor 42 is provided in the feed bin 16*a*** to ascertain the level of the feed in the bin.

The operation of a kiln produces vaporous hydrocarbon and some permanent gases. As these pass upwardly through the raw shale, above a retort zone, some of the hydrocarbons are condensed to produce a mist carried in the flowing recycled gas and the produced permanent gases. To prevent these from passing out through the feed mechanism purge gas may be introduced into the top of the annular level bin 46 into the space above the desired level of the oil shale. Normally the purge gas is a non-toxic gas which maintains a slight pressure in the space above the shale, which pressure is slightly higher than the pressure of the offgas and in the mist takeoff system, to prevent the same from passing through the shale and into the ambient atmosphere around the feed mechanism.

The quantity of shale on the belt is continuously determined by means of a load cell 50 (a commercially available unit) which is mounted under the top stretch of the belt to continuously weigh the quantity of shale on the belt. A commercially available density detector 51 includes a gamma radiation source 52 which passes gamma radiation through the material on the moving belt to a detector 53. Such a gamma radiation detector and source is currently on the market, and it is normally used for continuously weighing material of relatively constant specific gravity, and it is normally calibrated against a known weight of the material. According to the present invention, however, the variations in the gamma ray screening are continuously compared with the weight of the material determined by the load cell in a computer 55. The lead 53*a* from the detector is introduced into the computer 55 in line 53*a*, and the load cell measurements of the load cell 50 passes through line 50*a* into the computer 55. The determined weight from the load cell is passed into the computer to give raw shale feed rate in tons per hour. The variations in the gamma ray screening are continuously compared with the weight of the material on the belt so that the specific gravity of the material can be inferred. The volume of material is determined by the rotative displacement of the eccentric plug 36, and the rotation of the same is measured by a revolution counter. This is entered into the computer through line 36*a* to provide a volume for the computer. Thus the density on a basis of pounds per cubic foot of solid material may be easily determined. The bulk density and the specific gravity are, therefore, continuously determined. In a like manner, a very similar set up of the moving belt conveyor with a load cell and gamma ray source and detector is placed under the kiln associated with the belt for the retorted shale. This provides the weight and density of retorted shale entered into the computer through line 60, while the gamma ray radiation density is entered into the computer through line 61. The volume of the retorted shale is determined by the grate counter to provide the volume of the retorted shale withdrawn from the bed, and this figure is entered into the computer through line 62.

Figure 3:
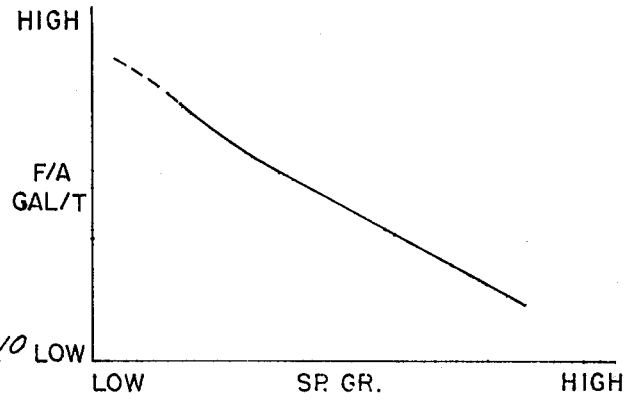
FIG. 3 is a general chart of the change of oil shale quality in relation to the specific gravity of the oil shale.

For Colorado oil shale, the relationship of shale quality (Fischer Assay based on gallons of oil per ton of shale) to specific gravity is known, and the general chart of FIG. 3 shows such a relation. The higher the richness of the shale, the lower is the specific gravity increases. In the retort operation, this is very useful in predicting the oil production rate from the kiln, and, also, making preliminary oil yield calculations. By providing a continuous reading on the oil shale richness the mining strategy of the mine can be monitored to provide directions for the mining production, such as blending shales from zones of different richness. The richness of the entering oil shale, also, provides means for adjusting the flow of the process fluids entering into the kiln along with the shale.

Figure 4:
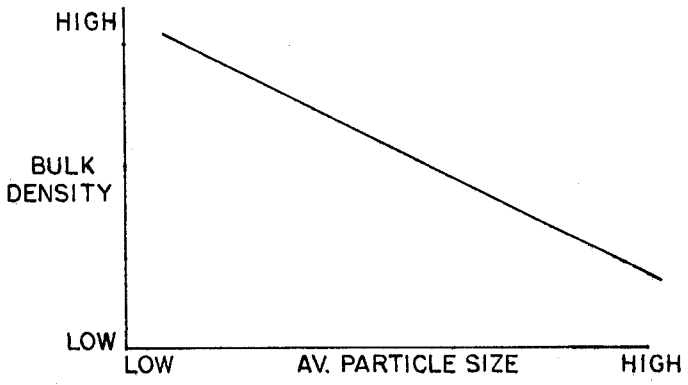
FIG. 4 is a general chart of the change of the bulk density with the change in the average particular size of the feed consist for a oil shale kiln.

The average particulate size of the entering oil shale may be monitored since the bulk density of the material changes in relation to the average particle size, as shown in FIG. 4. At the higher values of the bulk density, the average particle size is on the low side, while as the bulk density decreases the average particle size increases. This relation provides an insight to the quantity of fines entering the kiln, and this may be easily and continuously adjusted by changing the screening operation of the feed which enters the kiln. The bulk density is continuously monitored in quantity per unit of volume of the shale as determined by the movement of the eccentric plug feeder with the actual weight quantity of the shale determined by the load cell. The volume measurement is made by the rotating eccentric. The material which is displaced and pushed over the retarder plate is a constant volume per revolution of the eccentric plug. Thus, a single revolution will displace a constant volume. By appropriate continuously electronic computing of weight per minute and cubic feet per minute, a continuous read out of pounds per cubic foot of the feed and retorted shale is obtained. As shown in FIG. 4, the bulk density is related to the average size, and excessive fines shows up as a higher density of the incoming feed. Excessive fines are known to create problems in a kiln and thus corrective action may be immediately taken in the feed preparation and in the retort operation.

The feed material from the belt is introduced into the feed bin and level indicator 42 on the bin controls the speed of the drive of the plug feeder 36, maintaining a uniform depth of shale on the retarder plate 34. The material from the retarder plate falls into the annular bin, and by using the 6 level sensors (located at about 60° apart) the level in the kiln may be ascertained. An averaging circuit sends an average level signal to the grate control mechanism 65, and the grate speed is thus controlled to maintain a constant level in the kiln from the grate to the level sensors in the annular bin. The feed into each sector of the annular bin is constant from the rotary feeder. However, if the level of one or more of the sector is at a variance with the average, an indicator or alarm may signal the need of process or equipment adjustment.

An important feature of the combination of the eccentric feeder and the annular bin is the distributing and mixing action of the eccentric plug feeder. The radial movement of the feeder on the horizontal extent of the retarder plate moves all solids over the edges. In this way material falling from the conveyor belt becomes uniformly distributed over a large cross-section with minimum particle size segregation. For example, if the retarder plate is 20 feet in diameter, a 40 foot diameter kiln could be accommodated with a low vertical height for the feed mechanism.

The feed mechanism of the retarder plate and the annular bin provides an excellent position for the introduction of purge gas. The purge gas seals the top of the kiln to prevent the loss of product and toxic gases out through the feed mechanism.

What is claimed is:

1. A process for the continuous retorting of oil shale in a kiln having an inlet for particulate raw shale, an outlet for retorted shale, inlet means for process gas, and outlet means for gas entrained products of retorting, comprising:

(a) continuously feeding particulate raw shale into the kiln;

(b) continuously determining the bulk density of the raw shale by correlating the volume of incoming raw shale with its weight;

(c) continuously passing gamma radiation through incoming raw shale and detecting variations in a gamma ray detector;

(d) continuously determining specific gravity of the incoming raw shale by comparing the continuous weight of the incoming raw shale with the continuous gamma ray screening;

(e) and currently adjusting feed rates of incoming raw shale and process gas to compensate for changes in the raw shale feed.

2. A process according to claim 1, wherein:

the volume of incoming raw shale is determined by a volumetric feed means.

3. A process according to claim 1, wherein:

the retorting heat is supplied by internal combustion of combustible matter in the kiln and the quantity of air for combustion is controlled in relation to the bulk density of incoming oil shale and its specific gravity.

4. A process for the continuous retorting of oil shale in a vessel having an inlet for particulate raw shale, an outlet for retorted shale, inlet means for process gas and outlet means for gas entrained products of retorting, which comprises:

(a) continuously determining the bulk density of retorted shale by correlating a known volume of discharged retorted shale passing the outlet for retorted shale with the weight of said volume of discharged retorted shale, and (b) continuously controlling entering process gas rates to maintain effective retorting of the oil shale and maintain a minimum of carbonate decomposition, the degree of such decomposition being determined by the bulk density of the retorted shale.

5. A process for the continuous retorting of oil shale in a vessel having an inlet for particulate raw shale, an outlet for retorted shale, inlet means for the process gas necessary for the retorting and outlet means for gas entrained product of retorting, which comprises:

(a) continuously determining the bulk density of the raw shale by correlating the volume of the incoming raw shale to the weight of the known volume of said incoming shale, (b) continuously comparing the determined bulk density of oil shale with a chart of average particle to bulk density, and (c) continuously controlling crushing and screening operations for the raw shale to produce a desired size consist entering the vessel.

6. A process for the continuous retorting of oil shale in a kiln having an inlet for particulate raw shale, an outlet for retorted shale, inlet means for process gas and outlet means for gas entrained products of retorting, comprising:

(a) continuously feeding particulate raw shale into the kiln, (b) continuously withdrawing retorted shale from the kiln, (c) continuously introducing process gas into the kiln, (d) continuously determining the-bulk density of the raw shale, (e) continuously determining the bulk density of the retorted shale, (f) continuously controlling the feed rate of incoming raw shale into the kiln in relation to the bulk of the density, and (g) continuously controlling entering process gas in relation to the bulk density of the retorted shale to control carbonate decomposition.

* * * * *